US005821479A

United States Patent [19]

Kondo et al.

[11] Patent Number: 5,821,479

[45] Date of Patent: Oct. 13, 1998

[54] ELEVATOR PUSH-BUTTON DEVICE

[75] Inventors: Atsunori Kondo, Kawasaki; Kazuhiro Hattori, Yamato, both of Japan

[73] Assignee: Otis Elevator Company, Farmington, Conn.

[21] Appl. No.: 755,943

[22] Filed: Nov. 25, 1996

[30] Foreign Application Priority Data

Dec. 1, 1995 [JP] Japan ..... 7-313794

[51] Int. Cl.[6] ..... B66B 1/34; B66B 3/02

[52] U.S. Cl. ..... 187/395; 187/399; 187/397

[58] Field of Search ..... 187/395, 399, 187/397, 389, 280

[56] References Cited

U.S. PATENT DOCUMENTS

| | | | |
|---|---|---|---|
| 4,042,067 | 8/1977 | Mandel | 187/29 R |
| 4,805,739 | 2/1989 | Lind et al. | 187/121 |
| 4,915,197 | 4/1990 | Schroder | 187/121 |
| 4,972,926 | 11/1990 | Tsuji et al. | 187/137 |
| 5,398,783 | 3/1995 | Jacoby | 187/395 |
| 5,454,448 | 10/1995 | Bittar et al. | 187/395 |

FOREIGN PATENT DOCUMENTS

| | | | |
|---|---|---|---|
| 3-8677 | 1/1991 | Japan . | |
| WO92/10421 | 6/1992 | WIPO | 187/397 |

*Primary Examiner*—Robert Nappi

[57] ABSTRACT

A push-button device for an elevator is equipped with the function of both a hall button and a hall position indicator, and furthermore, the function of a destination floor button.

2 Claims, 1 Drawing Sheet

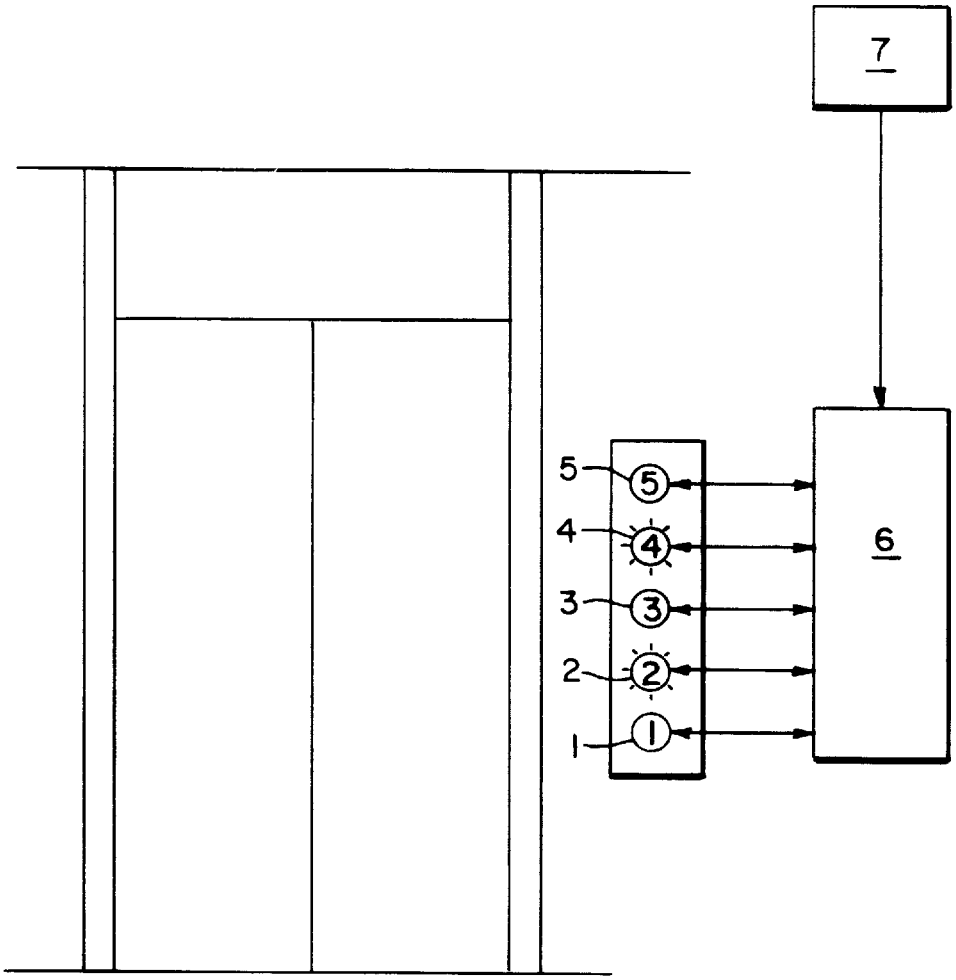
7
6
5
4
3
2
1

ELEVATOR PUSH-BUTTON DEVICE

TECHNICAL FIELD

This invention relates to a push-button device for an elevator having the functions of calling the car at a boarding location and displaying the destination floor, and displaying the position of the car.

BACKGROUND OF THE INVENTION

Until now, a hall button for the purpose of calling the car to the boarding location, and a hall position indicator that shows at which floor the car is currently positioned, have been provided at the boarding location for the elevator. In the case of using the elevator, when the car is called to the boarding location by pushing the hall button and the car arrives at the boarding location, this car is boarded and a destination floor button inside the car is pushed. When the car is called to the boarding location, the current position of the car can be known if the hall position indicator is looked at.

However, in known systems, there was a problem that at the conventional boarding location, two types of hall buttons and hall position indicators were necessary, and because of this the number of components became large for the entire system, and the cost became high.

Also, there was a problem that the hall button had to be pushed, and next the destination floor button within the car had to be pushed, in other words, the necessity that a button had to be pushed two times.

DISCLOSURE OF THE INVENTION

It is a principal object of the present invention to provide a push-button device for an elevator that is jointly equipped with the function of the hall button and the hall position indicator, and also with the function of the destination floor button.

According to the present invention, an arrangement comprises push-buttons that are provided in exactly the number corresponding to the total floors at a single boarding location, and when pushed, along with generating a boarding call, indicate the destination floor; light-emitting elements that are assembled in each push-button and that light a first color and a second color; a cage (car) position detection means that detects the floor at which the cage is currently positioned; and a control means made such that, when a push signal from an above-mentioned push-button is input, it causes the first color in the light emitting element of this push-button to light, and causes the second color in the light emitting element of the push-button which corresponds to the floor at which the cage is currently positioned to light, based on the signal from the above-mentioned cage position detection means.

Further and still other objects of the present invention will become more readily apparent when the following detailed description is taken in conjunction with the accompanying drawing, in which:

BRIEF DESCRIPTION OF THE DRAWINGS

FIG. 1 is a schematic drawing showing one preferred embodiment of the push-button device according to this invention.

DESCRIPTION OF THE PREFERRED EMBODIMENT AND BEST MODE FOR CARRYING OUT THE INVENTION

In FIG. 1, a boarding location for the elevator is shown, and push-buttons (1, 2, 3, 4, 5) exactly corresponding to all of the floors are provided on the face of the wall at this boarding location (1). Push-buttons (1, 2, 3, 4, 5) have covers made of, for example, a milky white acrylic resin, and numerals "1" to "5" indicating the floors are written on these covers. LED elements are assembled within the respective push-buttons (1, 2, 3, 4, 5), and these LED elements are made so as to light in yellow (first color) and green (second color), respectively.

Push-buttons (1, 2, 3, 4, 5) are devices which indicate the destination floor along with generating a car call. Whichever of the push-buttons (1–5) is pushed, this push signal is output to control panel (6) and the boarding location call is recorded, a light signal is output from control panel (6) to the LED element for the above-mentioned push-button, and this LED element lights in yellow. Due to this, push-buttons (1–5) function as hall buttons for the purpose of calling the car to the boarding location. The panel 6 is, for example, an electronic computer and includes, interconnected, a CPU, memory, I/O ports, buses, etc. and any suitable software to effect the present invention.

A signal from rotary encoder (7) (car position detecting means) is input to control panel (6) for detecting the position of the car, a light signal is output from this control panel (6) to the LED element for the push-button of the same number as the floor at which the car is currently located, and this LED element lights in green. Because of this, these push-buttons (1–5) also function as a hall position indicator showing the current position of the car.

Also, if a push-button (1–5) is pushed, the floor with the number of this push-button can be displayed as the destination floor. Because of this, push-buttons (1–5) also function as destination floor indicator buttons.

If the push-button (2) of the same number as the floor to which one wants to go is pushed at the boarding location, this push-button (2) lights yellow, and a boarding location call is generated. Also, simultaneously at this time, the destination floor is indicated. Because of this, the necessity to push the destination floor button within the car is eliminated, and one can get by with pushing the button one time. On the other hand, if a button that is lit green can be seen among the push-buttons (1–5), the current position of the car can be known.

Thus, according to this invention, because the push-button holds the function of a boarding location button and a hall position indicator, and also has the function of a destination floor button, the number of components can be reduced, and the cost can be lowered. Also, if the push-button is pushed at the boarding location, the inconvenience of again pushing the destination floor button inside the car is eliminated.

The device is equipped with push-buttons (1)–(5) provided with the numbers corresponding to the floors at each boarding location, and when pushed, along with generating a boarding call, indicates the destination floor; a light-emitting means that can produce a first and second color in each push-button; a rotary encoder (7) that detects the floor on which the car is currently positioned; and a control means (6) made such that, when a signal from one of the above-mentioned push-buttons is input, it causes the yellow color in the LED element within the push-button to light, and causes the green color in the LED element of the push-button corresponding to the floor on which the car is currently positioned to light, based on the signal from the rotary encoder (7).

What is claimed is:

1. A push-button device for each floor served by an elevator, characterized in that the device includes: push-buttons provided with numbers corresponding to floors at each boarding location, each of the buttons being configured such that when pushed, along with generating a boarding call, indicates the destination floor; a light-emitting means for producing a first and second color in each push-button; a car position detection means for detecting the floor on which the car is currently positioned; and a control means made such that, when a signal from one of the above-mentioned push-buttons is input, it causes the first color in the light-emitting element of the push-button to be produced, and produces the second color in the light-emitting element of the push-button corresponding to the floor on which the car is currently positioned, based on the signal from the above-mentioned car position detection means.

2. An elevator system for serving a plurality of floors of a building, comprising:

an elevator car; and car floor position detecting means for providing a floor position signal indicative of the floor position of said car;

characterized by the improvement comprising:

said system having on each floor of said building, a plurality of push buttons, one for each floor of said building, each having a number identifying the corresponding floor, each button, when pushed, generating a boarding call for service to the corresponding floor, each button having light emitting means for emitting light of a first color in response to a corresponding boarding call to indicate the destination floor of the call, and for emitting light of a second color in response to said floor position signal indicating the corresponding floor, to indicate the current floor position of said car.

* * * * *